United States Patent [19]

Ballentine

[11] 3,969,064

[45] July 13, 1976

[54] PROTECTION OF GAS BURNERS

[76] Inventor: Earle W. Ballentine, 3641 Via Palomina St., Palos Verdes Estates, Calif. 90274

[22] Filed: Feb. 2, 1976

[21] Appl. No.: 654,112

Related U.S. Application Data

[63] Continuation-in-part of Ser. No. 518,473, Oct. 29, 1974, abandoned.

[52] U.S. Cl. ..... 431/90; 126/39 J

[51] Int. Cl.[2] ..... F23H 1/02

[58] Field of Search ..... 431/90, 12, 19; 126/39 J; 137/101.21

[56] References Cited

UNITED STATES PATENTS

| | | | |
|---|---|---|---|
| 2,540,866 | 2/1951 | DeLancey | 431/90 X |
| 3,676,042 | 7/1972 | Osborne | 431/90 X |
| 3,782,881 | 1/1974 | Feeney | 431/90 |
| 3,843,310 | 10/1974 | Massi | 431/90 |

*Primary Examiner*—Edward G. Favors

[57] ABSTRACT

A circuit for protecting a gas burner is described to shut the flow of gas off, if the air blower fails.

1 Claim, 1 Drawing Figure

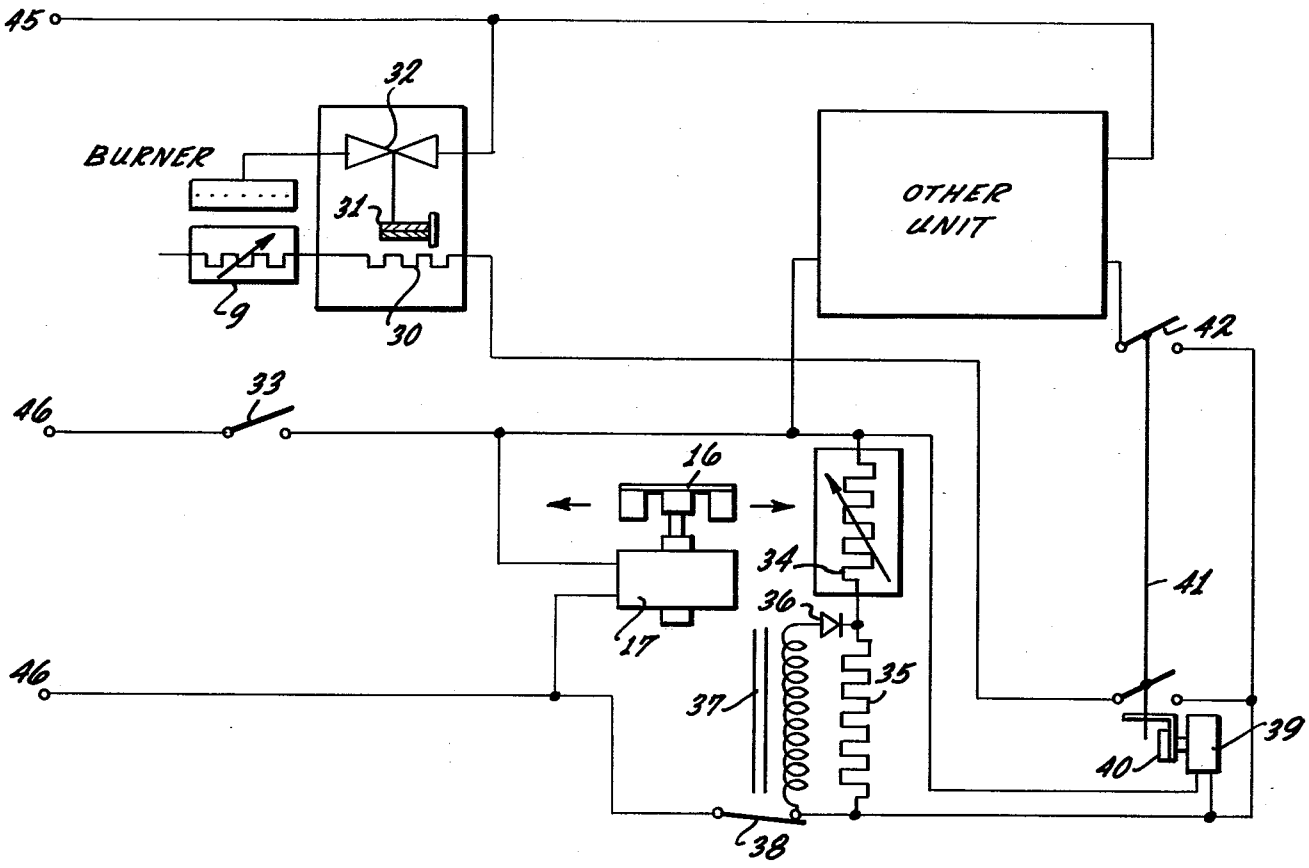
OTHER UNIT
BURNER
39
42
41
40
35
34
36
38
37
16
17
32
31
30
9
33
45
46
46

PROTECTION OF GAS BURNERS

This is a continuation-in-part of my application Ser. No. 518,473, filed Oct. 29, 1974 now abandoned.

BACKGROUND OF THE INVENTION

The glass-top electric range has experienced wide market acceptance and is destined to become a larger factor in the gas range market, because the housewife has found that it is very easy to clean. There is also a reduced fire hazard. The sales of gas ranges have decreased in the same ratio as marked penetration of the glass-top range sales.

My copending stoichiometric burner application with Ser. No. 419,514 is described on pages 7, 8 and 9. This stoichiometric burner shown in FIG. 5 which is a paraform-B type cannot be used in a radiation field.

My new stoichiometric burner entitled IMPROVED GAS BURNER was filed Sept. 5, 1975, and has the Ser. No. 610,564 and is a continuation-in-part of my application Ser. No. 580,544 filed May 27, 1975, now abandoned.

A new ceramic glass burner is disclosed also in another continuation-in-part application of the above-identified application Ser. No. 518,473 now abandoned.

DESCRIPTION OF THE INVENTION

It is an object of the present invention to provide for particular safety for such burners.

Proper operation of a gas burner depends on the flow of combustion air, which in turn depends on proper operation of the blower. There are two possible ways that the blower could fail, namely, the motor could burn out or the blower wheel could become loose, so that full blower speed would not be attained. To solve this problem, I have developed a very simply control. I connect two resistors in series wherein one of the resistors has a high temperature coefficient and the other resistor has a negligible temperature coefficient. The ballast wire can either be very pure nickel or a 36% nickel-iron alloy. I connect a small D.C. relay with a diode in series with one lead and the other relay lead is connected to the opposite end of the fixed resistor. The ballast wire would operate at a temperature of about 900°F, if there is no air flowing over it. Thus, the voltage drop across the ballast would be very large and the voltage drop across the fixed resistor would be very low. In contradiction, when the blower is operating, the ballast wire temperature would be very low and the voltage drop across the fixed resistor would be a maximum. Under this condition, the relay coil would have a maximum voltage and the blower would operate. I have found it necessary to use a D.C. relay with a diode in series with the relay coil in order to rectify the A.C. A D.C. relay has about a 3 to 1 dropout ratio.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings, in which:

the FIGURE is an electrical diagram of the control system.

As far as an example for a burner is concerned, I refer to the above-identified applications, whose contents are incorporated by reference.

The FIGURE shows a line for fuel gas connected to the gas main point 45 and enters the gas valve at 32 for feeding the burner. The gas valve 32 is actuated by the time-table actuator 31. The time-table actuator 31 is heated by a low temperature coefficient resistor 30. The low temperature resistor 30 is connected in series with the silicon carburetor igniter resistor 9. The electrical power is connected to the terminals 46. The system will operate when the switch 33 is closed. When the switch 33 is closed, the blower motor 17 will run. The timer motor 39 will then start. The timer motor 39 drives a cam 40. The linkage 41 is driven by the cam 40. The linkage 41 operates the micro-switches 42. The manually operated cams 43 control the stroke of the micro-switch plunger. Thus, the duty ratio of the switch can be varied from zero to full on. The blower wheel 16 which is driven by motor 17 discharges air over the ballast resistor 34 which is connected in series with the low temperature resistor 35. The D.C. relay 37 is connected in series with a diode at one terminal of the fixed resistor 35 and the other terminal of the D.C. relay 37 is connected to the other terminal of the fixed resistor 35. If the motor burns out or if the blower wheel set screw becomes loose, so that the flow of air decreases to a small value, the temperature of the ballast resistor will rise to a high value which results in a correspondingly high resistance value. Thus, the voltage drop across the ballast resistor 34 rises to a high value. Since the voltage drop across the fixed resistor 35 will decrease to a small value, the D.C. relay 37 will not hold the armature which actuates the switch 38 in the closed position as shown. Thus, the electrical circuit will open and all of the control system will shut down and the burner flame will be extinguished.

While I have described a preferred embodiment of the invention in considerable detail for the purpose of illustration, it should be understood that the invention is not restricted to the specific details which I have shown.

It will be apparent to those skilled in this art that many other embodiments, various changes and modifications may be made without exceeding the scope of the invention as defined by the following claims, wherefore, what I claim as my invention, is:

1. A burner for heating a cooking pan having a burner means, a combustion chamber above the burner means and an impeller driven by a motor for feeding air to the combustion chamber, an electrical control system for and connected to the motor, comprising:

ballast resistor means positioned in the stream of air flowing radially from the impeller means, one terminal of the ballast resistor means being connected to one side of the power line;

a fixed resistor connected to the other terminal of the ballast resistor;

relay means having a switch and a coil, the coil being connected to one terminal of a diode means, the other terminal of the diode means being connected to one terminal of the fixed resistor means, the relay being connected additionally to the other terminal of the fixed resistor means; and the switch of the relay controlling the power supply to the motor to turn the impeller off when the airflow across the ballast resistor decreases to a small value.

* * * * *